US009371681B2

(12) United States Patent
Tompkins

(10) Patent No.: US 9,371,681 B2
(45) Date of Patent: Jun. 21, 2016

(54) COURIER PACKAGE STORAGE APPARATUS AND METHOD FOR STORING COURIER PACKAGE DELIVERABLE TO A CUSTOMER

(71) Applicant: Blaine Kevin Tompkins, Burleson, TX (US)

(72) Inventor: Blaine Kevin Tompkins, Burleson, TX (US)

( * ) Notice: Subject to any disclaimer, the term of this patent is extended or adjusted under 35 U.S.C. 154(b) by 329 days.

(21) Appl. No.: 13/940,724

(22) Filed: Jul. 12, 2013

(65) Prior Publication Data

US 2014/0014008 A1 Jan. 16, 2014

Related U.S. Application Data

(60) Provisional application No. 61/670,811, filed on Jul. 12, 2012.

(51) Int. Cl.
*E05G 1/02* (2006.01)

(52) U.S. Cl.
CPC ..... *E05G 1/02* (2013.01)

(58) Field of Classification Search
CPC ..... E05G 1/02; E05G 1/00; E05G 1/026; E05G 1/04; G07C 9/00182; G07C 2009/00793; G07C 9/00817; G07C 9/0069; B60R 25/24; E05D 15/56; E05D 15/58; E05D 7/14; E05Y 2900/116; E05B 65/0075
USPC ..... 340/5.22; 109/30, 31, 38, 54, 55, 57, 109/64, 70, 71, 73, 79
See application file for complete search history.

(56) References Cited

U.S. PATENT DOCUMENTS

| | | | | |
|---|---|---|---|---|
| 6,116,461 | A * | 9/2000 | Broadfield et al. | 221/98 |
| 6,300,873 | B1 * | 10/2001 | Kucharczyk et al. | 340/568.1 |
| 6,570,488 | B2 * | 5/2003 | Kucharczyk et al. | 340/5.2 |
| 2002/0156645 | A1 * | 10/2002 | Hansen | 705/1 |
| 2004/0113786 | A1 * | 6/2004 | Maloney | 340/568.1 |
| 2009/0101724 | A1 * | 4/2009 | Byerley | 235/7 R |
| 2010/0037665 | A1 * | 2/2010 | Ace-Kirker | 70/56 |
| 2011/0041573 | A1 * | 2/2011 | Giles | 70/278.1 |
| 2012/0024942 | A1 * | 2/2012 | Skouboe | 232/24 |

* cited by examiner

*Primary Examiner* — Sisay Yacob

(57) ABSTRACT

An apparatus, and associated method, facilitates delivery of a package to a recipient. A personal package box is installed at a destination location. The box contains a locking device that permits a delivery person to secure the package, once delivered. An identifier is maintained at the personal package box. The delivery person records the delivery of the package, using the identifier to identify the location of the delivery. An indication of the delivery is sent to the recipient to alert the recipient of the delivery.

11 Claims, 7 Drawing Sheets

COURIER PACKAGE STORAGE APPARATUS AND METHOD FOR STORING COURIER PACKAGE DELIVERABLE TO A CUSTOMER

CROSS REFERENCE TO RELATED APPLICATIONS

This application claims the priority of provisional patent application 61/670,811, filed on 12 Jul. 2012, the content of which are incorporated herein in its entirety.

The present disclosure relates generally to a manner by which to protectively enclose a package that is either delivered to an address or is awaiting delivery from an address, without requiring availability or presence of the recipient or sender. More particularly, the present invention relates to an apparatus, and an associated method that, in general: allows a package to be picked up or delivered with only the participation and coordination of the delivery driver at a multitude of various customer locations; protects the package or object from weather and theft until such time as the delivery or pick-up takes place; provides a means of maintaining accountability and notifying the sender or receiver that the delivery or pick-up has occurred; offers targeted advertising to logistics/delivery companies; provides night, weekend or holiday delivery and pick-up capability; and offers significant delivery and pick-up efficiencies.

The personal package box is placed on or near the address mailbox, gate, doorstep, driveway, fence, store exterior, office building lobby, or gated community entry way. The box is expandable, such that it will accommodate any number of various sized objects from a standard envelope to a larger sized parcel package. The package box maintains a locking device or multiple locking devices such that the box is accessible by the individual delivering or picking up the package and by the customer who is sending or receiving the package. The personal package box will maintain, on the exterior or interior, a bar code, UPC symbol, or other identification device that is unique and identifies a specific address and/or a specific customer. This identification device will be used and, ideally, scanned by carrier personnel to confirm and account for delivery or pick-up of an item and, ultimately, to send notification to the customer by means of an automated text, email or phone system. The above apparatus and associated method will provide excellent protection for a parcel and reduce or eliminate the current requirement for a package delivery or receipt customer to be available for the transaction.

BACKGROUND

The history of parcel post delivery is a story of progress and change for the United States of America and, essentially, any developed nation. Communication ability is a distinguishing feature of the human being and has been desired, required and challenged since the dawn of time. From the early days of mail delivery by foot or beast (e.g. horse), this means of communication has capitalized on every advance made by humans in the areas of writing, packaging and transportation. From foot to horse, carriage to train, boat to plane, the capabilities for transferring and transporting communication between individuals has at least kept pace with current means, if not offered new motivation and profit for making the process of delivering various forms of communication more efficient and more expedient.

Eventually, as populations grew, travelled and moved, communication requirements increased as did the need for larger system capacity, efficiency and economies of scale. In fact, no longer were delivered items restricted to the small letter or hand-written communication. In time, individuals gained the ability to send other items such as clothes and linens, tools, gold, money, valuables, books, medical supplies, computers and whatever else one might desire to send to or purchase from one another. With the introduction of catalogue sales a completely new realm was entered. Where once an individual had to physically visit the point of sale, purchase and bring home the item, he or she could now simply order an item by phone or order form and have it delivered by parcel post. And then began the widespread use of the internet as a purchasing tool. The ability to see, compare, purchase and have an item shipped to a household without ever leaving home not only becomes easier, but seems on track to replace any other method of commerce.

Although the methods through which one is able to select and pay for goods purchased by phone or internet have become more flexible, user-friendly and convenient, there remains a challenge and burden that is not very flexible or convenient—the requirement to be available and ultimately sign for a delivered good of any significant value. In short, for example, after all of the convenience of selecting a product on the internet, from thousands of options of retailers and like items, at any hour of the day or night, paying by check, bank account, credit card, PayPal, etc. there remains the inconvenient requirement to be available, typically during business hours, for the delivery of the item that was so easily purchased and paid for.

In a world with an almost equal amount of women in the workforce as men, we are left with a great many households that cannot and do not want to be available for delivery during the "work day" or weekend at their residence or place of business. Even the women or men who do not work enjoy spending their day at the gym, on errands, a doctor appointment, at a child's school or extracurricular activity, on the golf course, at the beach, on vacation or any other endeavor that involves or requires absence from their residence. At present the package is either delivered on schedule with coordination and inconvenience to the customer and agent, re-delivered at a later date at a cost and inconvenience to the customer and shipper, is left, without customer availability, unattended and unprotected from weather and theft, or is required to be picked up at a central location during business hours, which is, again, an inconvenience to the customer and a cost to the shipper who services and maintains such a location.

It serves to reason that all involved, from the delivery company and its tracking service, to the driver servicing the address, to the individual making themselves available for pick-up or delivery, will benefit from a system that does not require both the coordination of driver and customer nor the eventual customer's presence when a delivery or pick-up is made. This challenge is even more significant in rural areas where the address is either remote, difficult to find, fenced and gated with no access to the typical front door delivery that is common in urban areas (drivers and customers are still required to either coordinate and arrange a meeting at the gate or offer access to the gate which involves more driver time to consummate the transaction), or is located on a property that requires a significant amount of foot travel or vehicle driving to reach the transaction point—typically a front door. Exacerbating the problem is the remote location where a driver may travel many miles to deliver one package with no intermediate, revenue building stops along the way. If this trip is fruitless and a package is not delivered, or the driver meets unacceptable delays, this entire process must be repeated at another date for additional cost to customer and shipper. Other, similar challenges lie in the delivery or pick-up from communal living addresses such as apartments or trailer parks or weekend deliveries to businesses that may not choose to operate on the weekends.

Even if the exchange, via pick-up or delivery, is executed perfectly, given the inconvenience to all involved, there remains the time consuming elements of the exchange that practically cannot be avoided and come at a cost. These time consuming activities include, but are not limited to: delivery agent walking up driveway or through yard; delivery agent waiting for customer to answer door; delivery agent taking the time to have customer sign for item and possibly partake in idle conversation that detracts from the bottom line; delivery agent walking or driving back down driveway or through yard. If the exchange is not executed perfectly the delivery agent is left waiting for customer at the gate or door and, perhaps, not making the delivery at all—which will require the whole process to be repeated.

Costs of failed delivery on the first attempt include, but are not limited to: fuel costs to and from the location for all attempts; driver time and associated wages for all trips; restock of item to be re-delivered; handling, tracking and scheduling of item to be re-delivered; storage costs and required capacity for undelivered items at the micro and macro level; intangible costs of perceived or real mistakes and miscommunications made by delivery agent/carrier in the eyes of customer, possibly influencing future service purchase decisions. The personal package box offers a dependable, consistent, one-stop pick-up or delivery option.

Exacerbating the risk is the fact that the delivery company is responsible for a parcel until delivery to the mutual customer. Challenges to this responsibility include theft and weather (precipitation, wind, storms, etc.). At present, even items that can be left without a signature or customer presence are susceptible to both thieves and the elements. The current solution involves, for example, a plastic bag that offers limited protection from the elements and no protection from thieves or severe conditions.

SUMMARY

A personal package box will solve many, if not all of the current challenges to efficiency, safety, security, convenience, flexibility, cost savings and consistency of service. The package box offers a dependable receptacle for the majority of delivered goods at the closest point of access to a property, increasing efficiency of delivery or pick-up, and making 24 hour, 365 day delivery options possible. The personal package box offers protection from the destructive elements of weather or pilfering efforts of thieves. In addition, the package box system will provide the necessary accountability, tracking and responsibility required of a valuable good while allowing the recipient or sender to carry on with their daily lives. The unique address or customer specific device, e.g. UPC code, will provide a substitute option for the standard signature delivery by validating a delivery or pick-up at the intended location, with confidence. The package box will allow a logical conclusion to the exchange, via the widely accepted methods of text, email and phone, without requiring the customer to be available at time of delivery.

Additional benefits that may be more difficult to quantify, but are nevertheless a benefit to the parcel carrier include, but are not limited to: customer satisfaction and loyalty; pulled demand for the service provided—for example, from customer to mass merchandiser to delivery company—in essence, the customer of the merchant demands the convenience of a shipping method that can deliver the product of a mass merchandiser through a method that adds greater benefit to the entire transaction process; advertising and branding—on the box and visible to all neighbors or passers-by; increased sales of pick-up service via more convenient method and accountability; and communal living opportunities and efficiencies through central delivery or pick-up box rather than item left at much travelled doorstep or signed for by inconvenienced customer.

Customer satisfaction will be an immediate realization to any individual who has been forced to be available for and coordinate a delivery or pick-up, often for an item that is likely not worth the time they take off work or another more rewarding activity. This satisfaction will drive demand for the convenience, flexibility, and practicality offered by the personal package box.

Demand will influence mass-marketer behavior and service contracts through either the direct request of the customer or through perceived benefits to the entire process of sale and delivery.

Advertising, through branding and an image on the package box, will be focused and directed toward specific potential customers, neighbors, and will have unlimited visibility on a daily basis. Sales will be promoted through word of mouth by credible spokesman—friends and neighbors. The benefits and practicality will be espoused freely and credibly, rather than being "sold" by a commercial or ad campaign. Further, the process by which the box works will be easily understood by the average person who sees the box just one time.

Sales of pick-up service will increase with the relaxed requirement for availability during business hours that is required at present, especially for the shipment of valuable or sensitive items and documents. This service will also offer the same one stop option as listed above where there is no coordination required and pick-up is assured. Easing the typical constraints to sending packages from home is the option to have more envelopes and empty containers left for the customer who simply orders more by phone or internet.

The package box offers in a larger, more central application, the ability to service communal living from a single location, magnifying savings and efficiencies. In the form of a single box with several package receptacles and a unique UPC sticker, e.g., for each unit, the central package box can serve all of the units of an apartment, trailer park, condominium, gated neighborhood, military housing, or other similar communal living arrangement. The benefits in time, flexibility, efficiency and security will be realized by all, regardless of whether the customer is available or not.

In general and in short, the package box offers a multitude of benefits to the package delivery company, e-commerce industry and the mutual customer of both. In addition to the one stop transaction consistency and dependability there are many other efficiencies, conveniences, cost savings and security measures realized by all involved.

DETAILED DESCRIPTION

Figure 1:
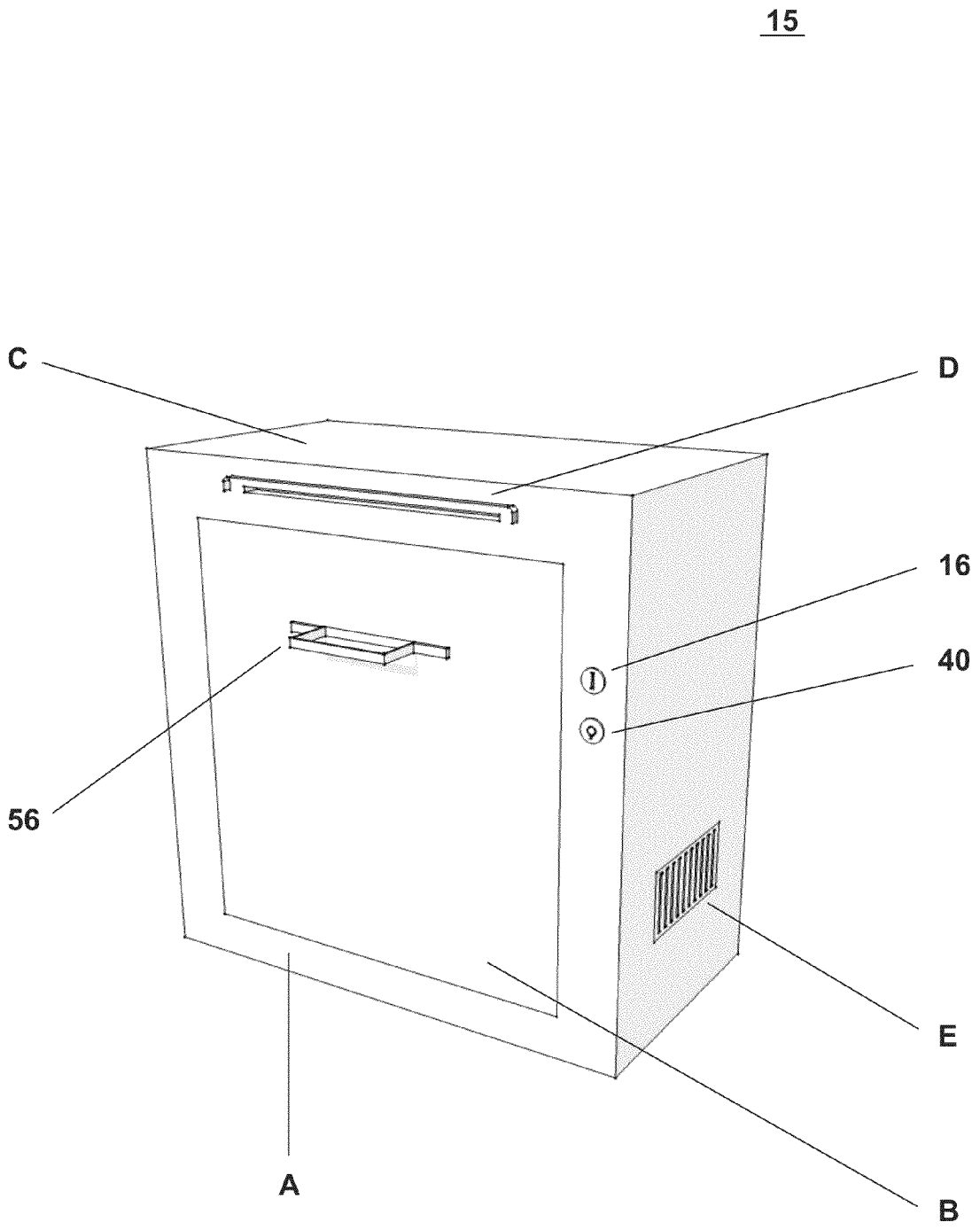
FIG. 1 illustrates a representative of the apparatus for receiving or delivering a package of an embodiment of the present invention.

The present disclosure, accordingly, advantageously provides an apparatus, and an associated method, by which to protectively enclose and hold an envelope, package or other shipped item, collectively referred to as a "package", that has been delivered or that is awaiting pick-up for delivery. The disclosed method removes the requirement for a customer, recipient or shipper, to be available at the time of pick-up or delivery, protects the package until pick-up or after delivery from thieves and the elements, provides both the accountability for a verified, safe and secure transaction as well as a system for notifying or alerting the customer that the transaction has been completed, allows for 24 hour, 365 day delivery, and provides an effective advertising medium.

Through operation of an implementation of the present disclosure, a manner is provided by which protectively to enclose a package of a larger size than the enclosure occupies in its normal form. This operation involves and includes the ability to expand in size while maintaining the same protective function and benefit of the reduced size.

Through operation of an additional implementation of the present disclosure, a manner is provided by which a bar code, UPC symbol or other device is used to establish, maintain and identify a specific address or customer. The implementation of this method may be utilized to track a given package, account for and verify delivery or pick-up of a package, substitute a signature requirement, and alert or notify a customer of the delivery or pick-up of the package. The notification method includes, but is not limited to, email, text, phone or any other commonly accepted communication method. Notification is initiated, for example, by a handheld bar code scanner or other similar device that is used by delivery personnel to scan the address specific code or marking. The scanning device then relays a signal to the appropriate computer based software or routing system which, ultimately, sends a notification to the customer and identifies the transactions as complete to the shipping company.

In one aspect of the present disclosure, a square, rectangular or other appropriate shape, collectively referred to as a "box" or "enclosure", is formed of a light weight but durable material such as sheet metal, plastic, fiberglass, or aluminum. The material exhibits characteristics that protect from the elements of weather such as wind, rain, hail, snow, sleet and any other production of nature that threatens the physical integrity of a parcel package. In addition, although not "theft proof" the box will be constructed of such materials, means and design so as to offer a "theft resistant" quality, comparable to that found in any other similarly manufactured, sealed and locked apparatus.

In another aspect of the present disclosure, the outer box is constructed such that it is sealed on all sides and corners, whether in a compact or expanded state, and provides a barrier against weather or theft. However, the composition of the box allows for access by a package delivery agent or the owner of the box apparatus. Access is made possible by a lid, door, or other widely understood and accepted method of access to the interior of a box.

In another aspect of the present disclosure, the common, compact size of the package box is expandable into larger dimensions while maintaining the same contact point and basic area in space. As an example, the front of the box is pulled out on a hinge or rail system similar to a standard cabinet or drawer. As the "drawer" is pulled out to its maximum capacity it is then locked in place to become a solid receptacle for the package, exhibiting many of the structural integrity characteristics of the box in its normal or compact state. This method allows the disclosed apparatus to accept a larger package than could be achieved with a smaller, standard, rigid size, while still allowing the box to take up less space, be less cumbersome and more aesthetically pleasing in its normal, compact state.

In another aspect of the present disclosure, a lid or covering apparatus will enclose the top of the expanded box and thus form the final side and security of the newly formed expanded shape. This system will use, for example, a rolling, segmented lid similar to that used on a rolling shop door, or a segmented collapsible mechanism much like that used on a garage door. Both exemplary methods may be capable of stopping at an intermediate position, if the situation warrants, or extended to the maximum capacity of the extended shape of the expanded box.

In another aspect of the present disclosure, a front door is included which will serve as the access point whether in a compact or expanded state. This front door utilizes a pivot point on any of the various sides, e.g. a hinged top, to offer full access to the interior of the box. In this exemplary method, the envelope slot and locking mechanisms are also contained on this access door to facilitate use in either compact or expanded state. Opening or closing, in this example, is accomplished by way of an attached handle.

In another aspect of the present disclosure, an envelope slot is provided to allow easy insertion of a small or large envelope without the requirement to open the box by other means. The slot will exhibit one or several characteristics that protect against the penetration of elements (e.g. rain) into the box. These characteristics include, but are not limited to: angle of attachment for protective shield, a rubber squeegee type attachment, a synthetic or natural bristled attachment, or other practical means of, for example, keeping the interior of the box dry in rainy conditions.

In another aspect of the present disclosure, one or more locking mechanisms are provided to secure the box and allow access by only authorized agents, customers or owners. The locking mechanism includes, for example, one of the following means: standard keyed lock, digital button or key pad, combination lock, electronic entry device (similar to the garage door opener, for example), or biometric device such as a hand, palm or fingerprint reader. In one application of the current method for example, a front door lock makes the box accessible to all delivery drivers via a key that allows a common access point to all package boxes served by a particular delivery service. In this example, also provided is a unique lock with a unique key used by the resident or customer that allows access by the same front door—essentially opening or closing both locks. The same is true for the delivery agent who gains access by one key that utilizes a mechanism that opens or closes both locks.

In another aspect of the present disclosure, the box utilizes multiple access points and, through the use of various locking mechanisms, access by separate methods for either the driver or customer. For example, one method may allow access by the delivery agent through a front access door, while the customer gains access through a back or side door. The top lid is another option for an access point.

In another aspect of the present disclosure, the package box uses an identification device such as a UPC symbol, standard bar code, unique number or symbol(s), or other decal or method that distinguishes and identifies a unique address for each customer. This identification device is placed on the interior or exterior of the box and is accessible for use by the delivery agent. The identification device is used to track package delivery, provide accountability for the delivery agent and, ultimately, to alert or notify the customer that a package has been delivered or picked up—thus reducing or eliminating the requirement for the customer to coordinate and be available for a given transaction, which is the essence and major goal of the entire system for both the delivery company and the customer. This customer/address unique symbol at a specific location, combined with the requirement for a carrier agent to be physically present in order to complete a scan, provides overwhelming evidence of package delivery or pick-up and is second only to a signature in accountability—which this process is also designed to replace.

In another aspect of the current disclosure, the identification by a handheld bar code scanner. As the item is scanned, the unique address and customer data is sent and then retrieved by a computer software or tracking system. This system subsequently alerts or notifies the customer by way, for example, of automated email, text, phone call, or any other current notification or communication transfer means. In essence, the customer, after ordering and expecting delivery of a package or placing an item to be delivered in the box, can go on about their daily lives and be assured that the package will be delivered or picked-up with a requisite amount of accountability and tracking by the delivery service.

In another aspect of the current disclosure, the box offers space for advertising and branding by either the exclusive delivery company with ownership or license to the box system, or a multitude of carriers that have access to the box and the motivation and desire to pay for such advertising.

In another aspect of the current disclosure, the package box may be placed in any convenient location that is accessible by the delivery agent and which does not impede or conflict with the United States Postal Service mail box. The placement options include, but are not limited to: attachment to mailbox; free-standing post behind or near mailbox; concrete pad in any convenient location; via brackets for a fence or gate; near the driveway by any various means; at the front door of a residence attached to a wall or pillar or through use of a bracket that allows for easy placement and removal of the box when not use; at a store front or side of the building (i.e. a common strip center access point); a central location for communal living such as an apartment complex, trailer park, condominium area, gated community, nursing home, military housing, office building lobby, etc.

In another aspect of the current disclosure, the package box may take on a significantly larger shape to accommodate communal living applications. In this application, for example, the box may have several large but segregated access points and spaces that allow the delivery of multiple packages to the same general location, but to different customers at distinct unit numbers. Differentiation and accuracy may be achieved by the application of a specific, unique bar code or UPC symbol, for example, for each unit that is serviced by the communal box. Each identification item is accessible by the delivery agent, for example, all posted on the side of the box. The driver is able to scan or otherwise enter the code for a particular resident, among many, thereby notifying only that particular customer of a delivery or pick-up. Access by the driver is via a common lock and key on each access point. Access by a specific customer is achieved, for example, by an access code to a digital lock that is sent in the text, email or phone notification message or through the use of common keys maintained by the apartment manager.

In these and other aspects, therefore, an apparatus, and an associated method is provided for protectively enclosing an object or package while awaiting pick-up or post-delivery. An outer box is provided that is capable of expansion to a larger shape with the same basic protective attributes. An entry method is provided by one or more various means that also includes one or more locking devices for access by a driver or customer. A unique symbol or device is provided to identify and subsequently notify a customer or box owner of a completed transaction, whether delivery or pick-up. A method is provided to take the initial, unique identification and translate it to a customized communication to the customer while also tracking or accounting for the completion of the service by the delivery company.

Turning first, therefore, to FIG. 1, a protective enclosure, shown generally at 15, provides a receptacle for an object or package. In the example presented in 15, the enclosure is comprised of 6 connected sides: a top, a bottom, a front, a back and two sides. The example in 15 is constructed by way of any material or combination of materials that are commonly known to provide the requisite protection from elements of nature or theft, e.g., sheet metal, aluminum, plastic, fiberglass, or steel.

In the exemplary implementation shown in the figure, A, represents the front face of the enclosure in an enclosed, compact, non-expanded state. B illustrates an exemplary method of entry to the enclosure by way of a door or pull-out drawer, using either a hinged or rolling mechanism, respectively. In this example, either method of entry is complemented through the use of a handle, 56, that is used assist with the opening of the door or drawer.

A rain cover device, C, is provided to cover and protect an envelope slot designated, in this example, by D. The slot, at D, is further protected, for example, by a material such as horse hair, a synthetic material, or rubber squeegee type device that fills the opening created by the slot, adds protection to the inner area of the box and enclosed package, while allowing deposit of an envelope through the same medium that protects the slot.

The protective enclosure, 15, includes a method of secure access, in this example, through locking mechanisms found on the front face, A. Illustrated at 16 and 40, either keyed device will open or close the other locking device, thereby allowing a secure means of opening and locking both locks by either an authorized delivery agent or customer.

The protective enclosure at 15, in this exemplary illustration, will utilize a UPC code, at E, which identifies a unique address location and/or customer. This symbol, whether on the interior of the enclosure or on the outside, as depicted, is easily accessible by the delivery agent for scanning and entry into the tracking and notification system. In addition to a UPC symbol, the device is comprised of any other similarly effective means, e.g., bar code, customer or box number, alphanumeric symbol, or other similarly fashioned device that will allow the delivery agent to quickly access and scan and subsequently enter customer information into the system for tracking, accountability, and notification.

Figure 2:
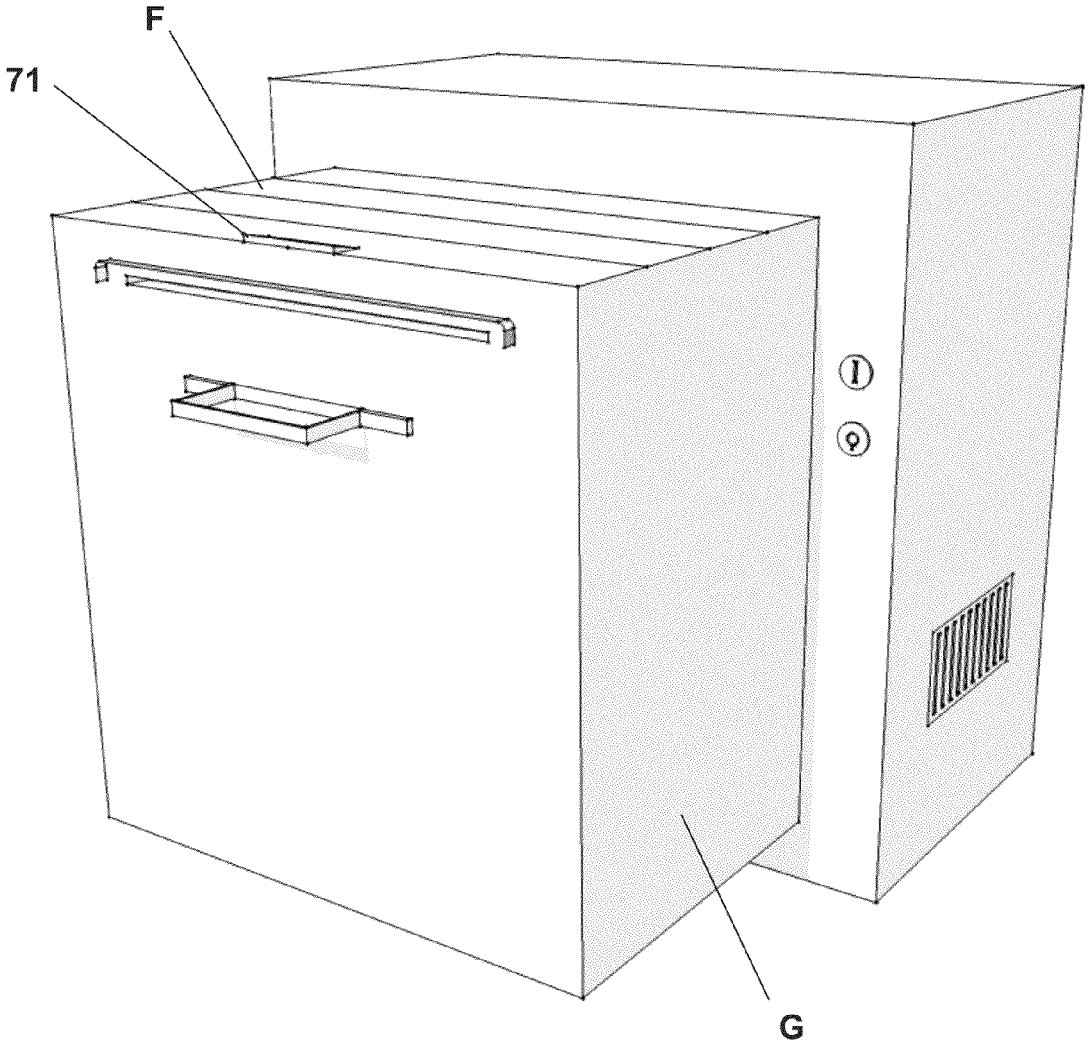
FIG. 2 illustrates another representation of the apparatus for receiving or delivering a package shown in FIG. 1, here illustrated in an expanded state, such as to receive or deliver a larger package than the non-expanded state.

Turning next to FIG. 2, the protective enclosure 15 is again shown. In the illustration of FIG. 2, the protective enclosure in the form of a package box, is in an expanded configuration. That is to say, the protective enclosure has been enlarged, through manual means and mechanical options, to be of a greater shape and size than that of an enclosed, "normal" state. While expanded, G represents the expanded portion of the box that would otherwise be enclosed by the normal size, referenced in FIG. 1. The expanded portion, G, is demonstrated in its fully expanded and locked position, but is capable, in other applications, of remaining locked and secure in any number of various intermediate positions. Actual size and utilization of the locking positions is at the discretion of the user, whether delivery agent or customer. In this example, only one, fully expanded position is illustrated.

Also identified in FIG. 2, is an exemplary expandable drawer with four rigid sides: a bottom, a front, and two sides. In addition to these means of enclosing the expanded state, is the method of enclosing the top of the expansion by means of a moveable top apparatus, F. This top is, e.g., designed and constructed of a segmented, but attached and secure top, serving the function of a lid. In this example the lid has been moved to a fully closed position whereby the entire expansion is enclosed. This lid or top may be opened to deposit or retrieve a package. This closure is complemented by the use, for example, of a small handle on the top, front side of the lid, identified as 71 on FIG. 2 and contained within G.

It is in this expanded state, represented by FIG. 2, that a package of larger dimensions than could be contained by the normal size in FIG. 1, can be housed and protected by the larger condition of FIG. 2. This increased capacity is of great benefit to both the customer and delivery agent by greatly increasing the capability of the enclosure to accommodate a wider breadth of deliverables in various shapes, sizes and dimension.

Figure 2A:
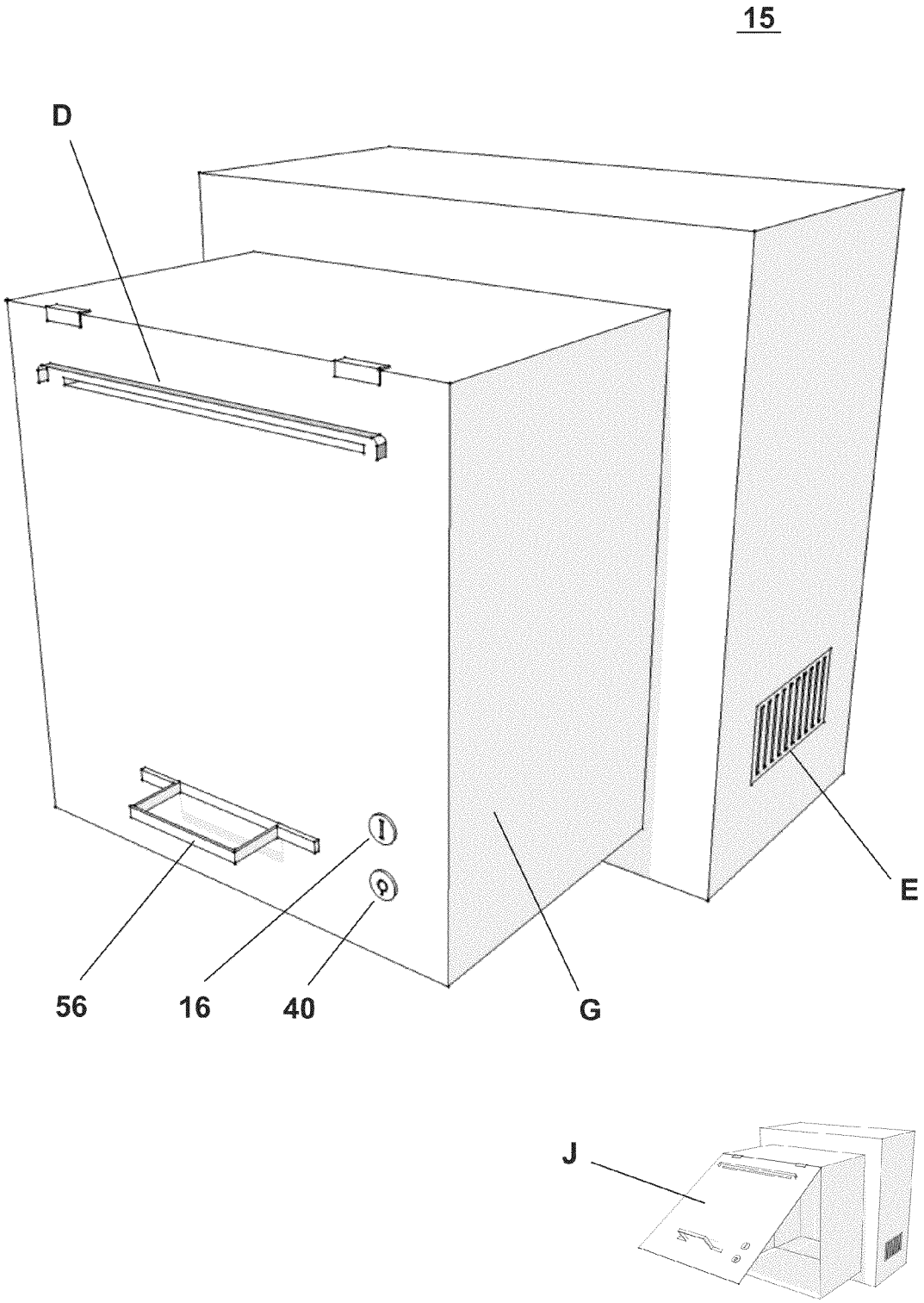
FIG. 2A illustrates another representation of the apparatus for receiving or delivering a package shown in FIG. 2, here also illustrated in an expanded state, but with several modifications that embody a preferred application of the present disclosure, also designed to receive or a deliver a larger package than the non-expanded state. Generally, this application combines all of the locking and envelope slot options into a front door access point and includes five solid, enclosed sides.

Turning now to FIG. 2A, an exemplary method of expansion of the package box is illustrated. This application is similar to FIG. 2 with respect to basic dimensions, capacity and utility. In this example however, the expanded state uses a solid top in place of the segmented access top delineated in FIG. 2 and on component G, as well as a front access door. The front access door, for example, utilizes a hinged top and bottom handle. The locking mechanisms, 16 and 40, are contained on the door itself, versus the main compartment, to ease the locking/unlocking process whether the box is in a compact or expanded state. In addition the letter slot, reference D, is also now included on the front door access. All other attributes listed with FIG. 2 are exact or similar in nature, functionality and designed use.

The current disclosure in FIG. 2A is designed to open and provide access in the same fashion, whether in a compact or expanded state. Both states will utilize an open front door, illustrated by J, which provides the full capacity of the interior and is limited only by the size of the door itself which, in this example, encompasses the entire size of the height and width of the expansion at G.

Figure 3:
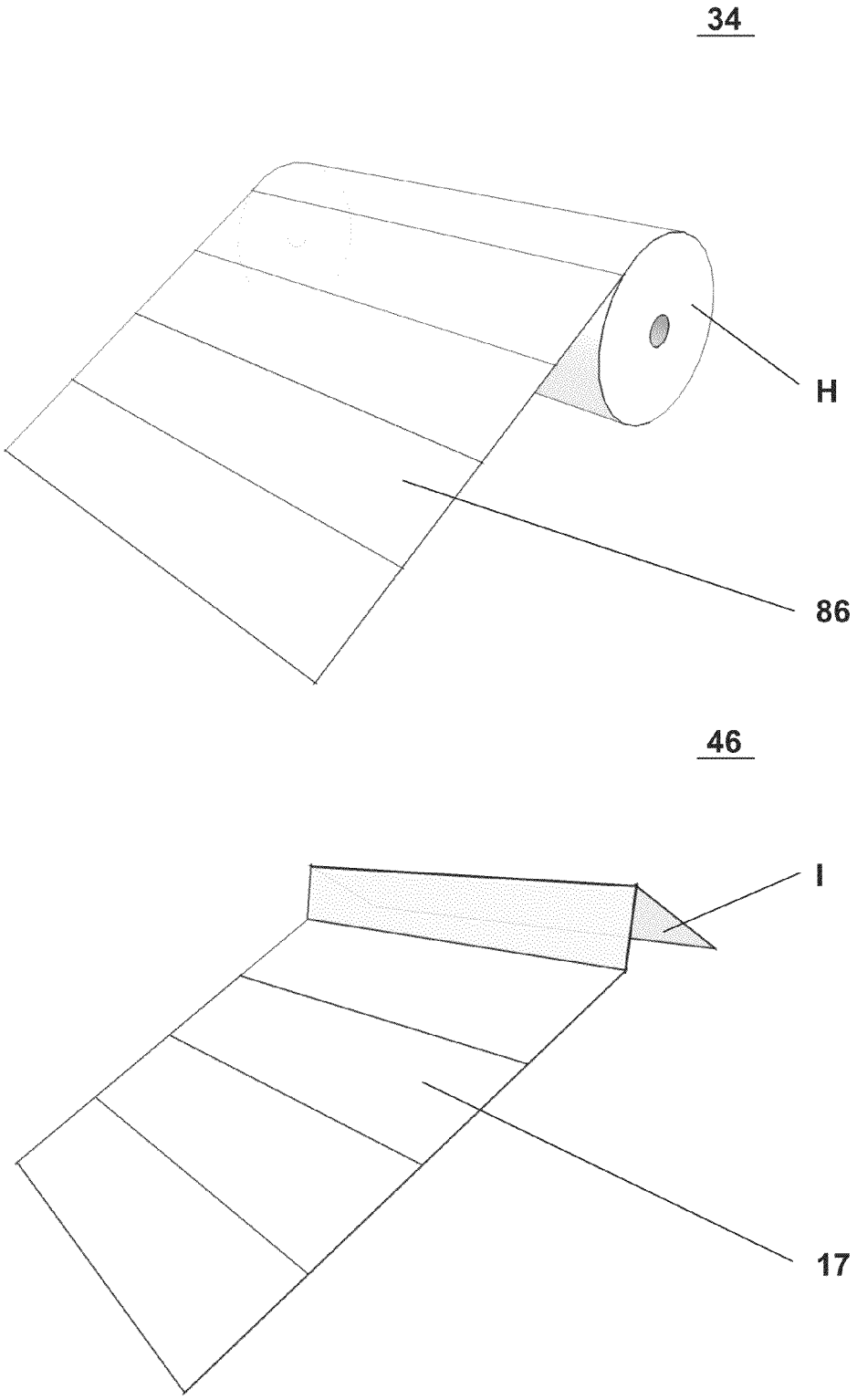
FIG. 3 illustrates a portion of the apparatus shown in FIGS. 1-2, showing representative embodiment of a lid or covering mechanism that encloses and secures an expanded state for the method of receiving or delivering a package.

Turning now to FIG. 3, the lid is represented in two of many various means of enclosing the top of the expanded enclosure shape. In 34, the lid is constructed as a round, roll type mechanism, H, closely associated with that of the typical roll-type shop door. The segments, at 86, are capable of rolling together on H, to be contained within the normal, compact shape in FIG. 1, or flattened in movement toward and to the expanded shape in FIG. 2. An additional method, 46, is provided to illustrate one alternate method that utilizes an accordion-style compaction method, much like a garage door, where the segments, 17, are flattened together to stand on edge in a smaller shape that can once again be contained within the normal size of FIG. 1, or expanded to a flatter dimension for use in the expanded shape of FIG. 2.

Figure 4:
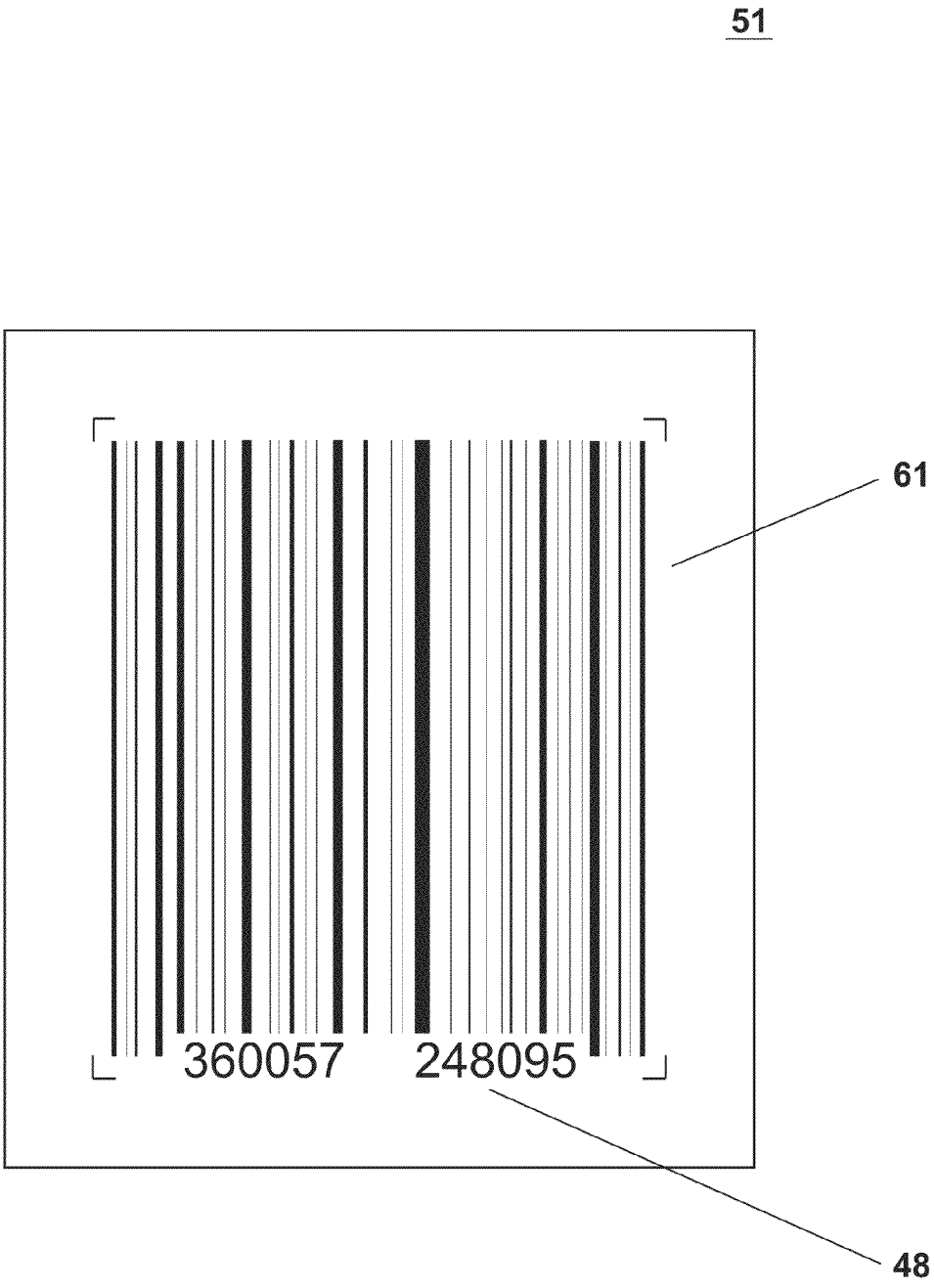
FIG. 4 illustrates a portion of the apparatus shown in FIGS. 1-2A, showing the unique, distinguishing element that identifies a specific address and is used to notify the customer of delivery or pick-up.

FIG. 4 illustrates an example of a unique identification device used in the method of implementation of the package enclosure that identifies a specific address and/or customer. The UPC symbol, represented by 51, is an exemplary method of transmitting information, by way of a UPC or bar code scanner, that, once read, is capable of transmitting the address location of a delivered package or package pick-up, and also the method of transaction notification specified by and for the particular user or owner of the protective enclosure. 61 illustrates the uniquely sized bars used by a standard UPC symbol as well as the unique numbering convention, 48, used by the same. One or both are used to identify specific information provided by the box and customer.

Figure 5:
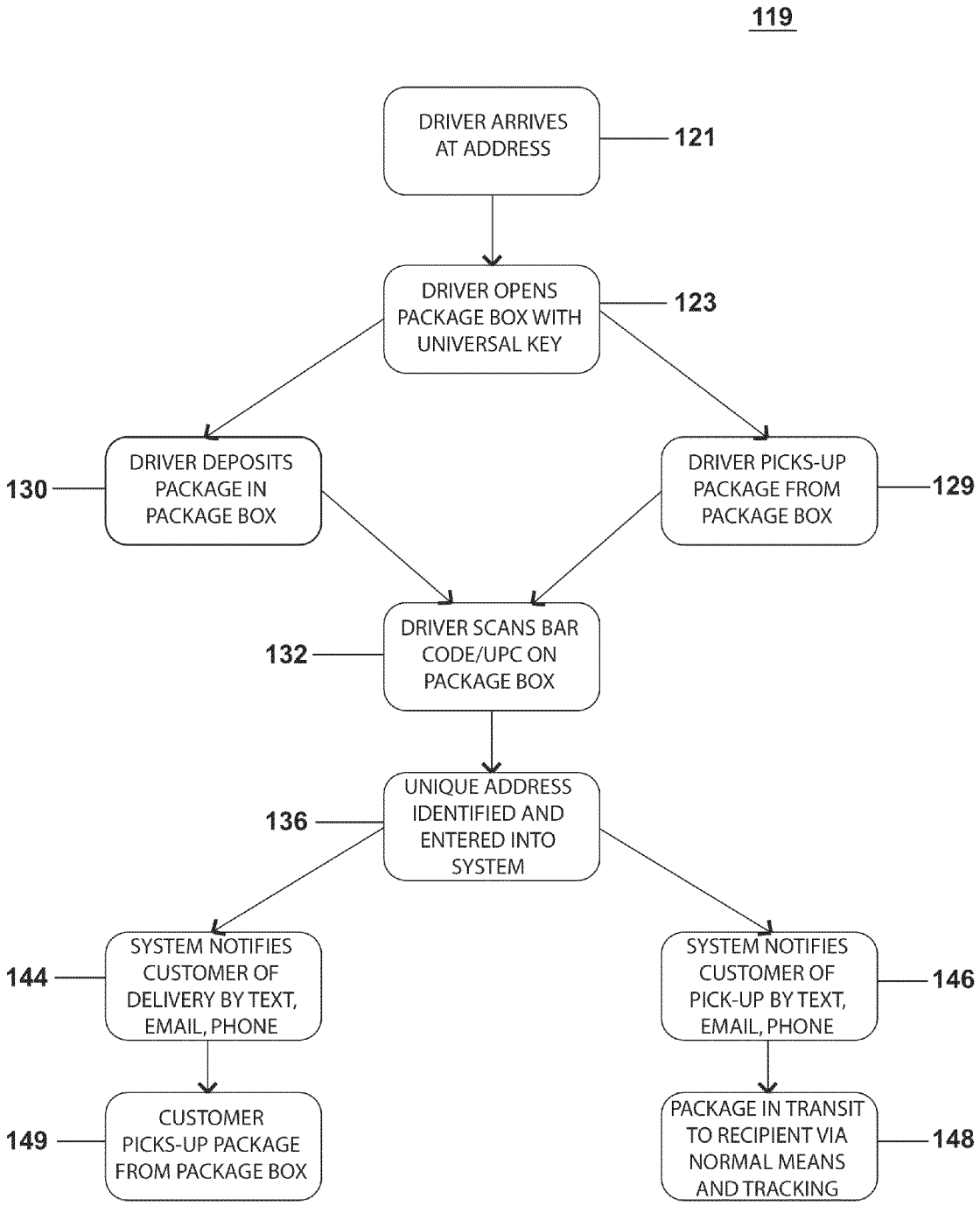
FIG. 5 illustrates a method flow diagram representative of the method of operation of an embodiment of the present method of invention with respect to package delivery or pick-up.

FIG. 5 illustrates a method, 119, representative of the method of operation of an embodiment of the present disclosure. The method facilitates protective enclosure, accountability and information transmittal for a package delivery or pick-up.

First, as indicated by the block 121, the delivery driver arrives at a particular address to deliver or pick-up a package. Then, and as indicated by the block 123, the driver opens the package box with a universal key. And, as indicated by 129 or 130, the driver picks-up or deposits a package, respectively. Subsequently, in 132 the driver scans the bar code or UPC. In 136 the unique address identified in 132 is located and entered into the computer/software system.

In the case of a package delivery, 144, the system notifies a specific customer by way of, e.g., text, email or phone, that a package has been delivered. To complete the transaction in 149, the customer retrieves the package from the protective enclosure.

In the case of a package pick-up, 146, the system notifies a specific customer by way of, e.g., text, email, or phone, that a package has been picked up. In this case, 148, the customer has the peace of mind that the package has been retrieved and is on its way and can now follow the progress of the shipment through the currently available tracking means.

Figure 6:
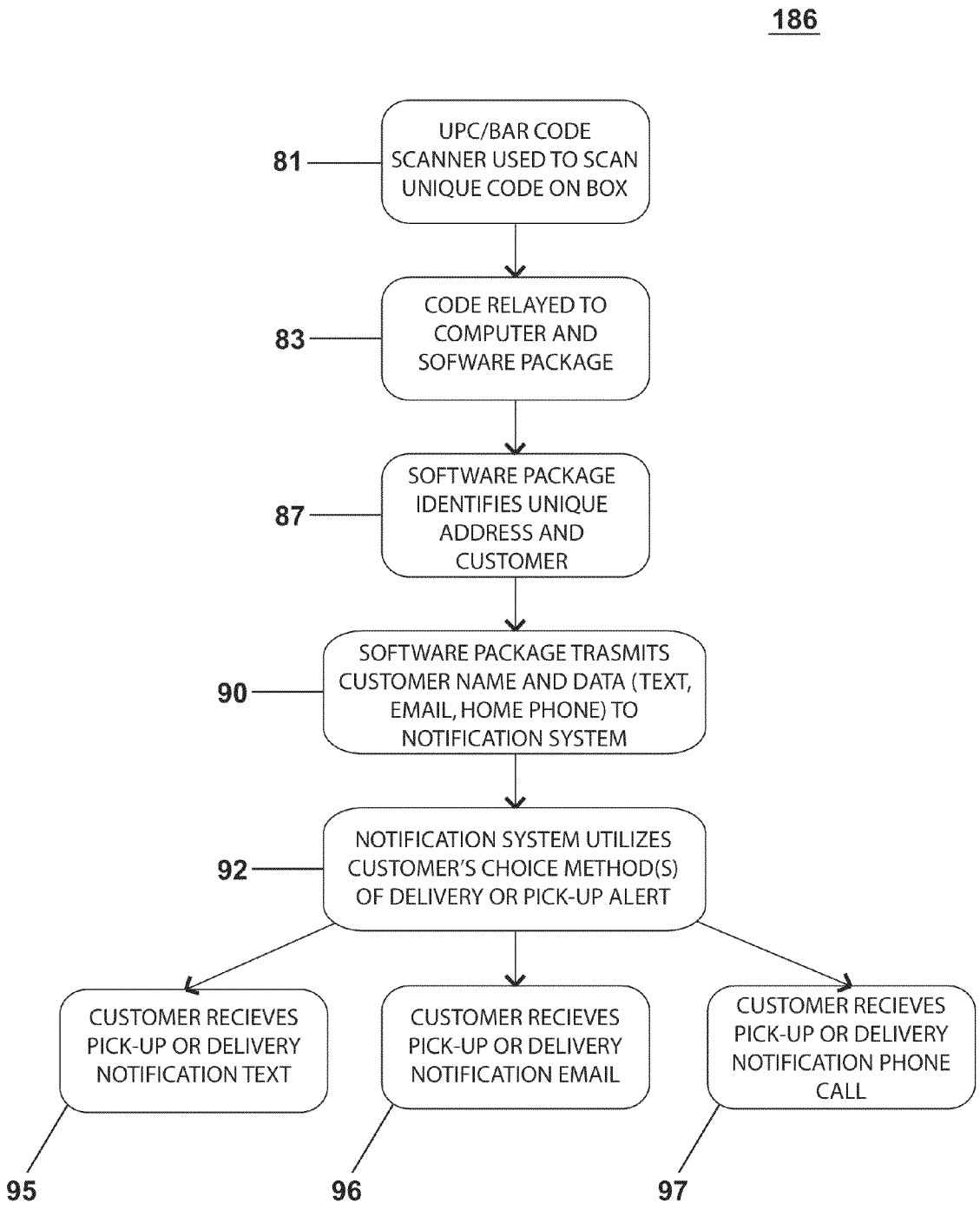
FIG. 6 illustrates a method flow diagram representative of the method of operation of the embodiment of the present method of invention with respect to the accountability and transmittal of delivery or pick-up consummation and ultimate notification of end customer to the same.

FIG. 6 illustrates a method, 186, representative of the method of operation of an embodiment of the present disclosure. The method facilitates accountability and information transmittal for a package delivery or pick-up.

First, as indicated by 81, a UPC or bar code scanner is used to scan the code provided on the protective enclosure box. The unique information identified by the scan is then relayed through 83, to a computer and software package for dissemination of information and further action by the system. The software package, 87, identifies a unique address and/or customer and then, in 90, transmits a specific customer name and data to the notification system.

Finally, in 92, the notification system utilizes customer choice method(s) of delivery or pick-up alert and communicates the transaction to the customer by way of text, 95, email, 96, or phone call, 97.

Wide spread use of the box may allow a carrier, e.g., to "assist or help" the failing USPS and basically take over some of its routes, starting with rural delivery and pick up. For instance, the carrier delivers or picks up mail that is near the route it has to cover anyway. The driver picks up mail from the Post Office in the morning and then picks up and delivers mail along the route he must travel to deliver his own packages. The Post office changes to a smaller, more flexible group of drivers who do not have assigned routes. The USPS driver now only serves the areas not covered by the carrier in rural locations. The driver drops off all collected mail at the same location at the end of the day. The carrier benefits by adding revenue to a route it would have travelled anyway. The cost is increased time to complete the route. The USPS benefits long term by reducing the amount of required drivers and eventually their salaries, pensions and associated costs. The cost is revenue sharing with the carrier.

In other distribution methods, the mechanism is free to customers who do a requisite amount of business with the carrier. Additionally, a rebate program is provided to those who demonstrate use of the service and the carrier after a purchase or free to all who want it. The value is in the long term patronage and use of the apparatus, not necessarily in the one-time purchase of the box.

The carrier can create aesthetically pleasing color schemes to be more palatable to the customer, e.g., matching the paint schemes of fences, gates, mailboxes, or front door settings, etc. While also, producing more compact or even removable package boxes for urban settings where the front door atmosphere is more visible and critical.

Methods for ordering more shipping materials include an online request to be delivered in compact or collapsible form to the customer in their personal package box for use in delivery services. Additionally, operation provides customers with options for nights, weekends, or holiday deliveries and pick-ups.

Presently preferred implementations of the disclosure and many of its improvements and advantages have been described with a degree of particularity. The description is of preferred examples of implementing the disclosure, and the description of examples is not necessarily intended to limit the scope of the disclosure. Variations and further embodiments are contemplated. For instance, additional methods to counter competition circumventing method of delivery alert include a push key pad, a unique number, etc. The scope of the disclosure is defined by the following claims.

What is claimed is:

1. An apparatus for storing a courier package, said apparatus comprising:

a housing configured to form a courier-package supportive enclosure, said housing having an aperture permitting placement of the courier package within the courier-package supportive enclosure, said housing having a lockable front door openable to access the courier-package supportive enclosure;

a first lock configured, when locked, to prevent access to the courier package, when positioned within the courier-package supportive enclosure and, when unlocked, to permit placement of, and retrieval of, the courier package to, and from, the courier-package supportive enclosure;

a second lock, separate from the first lock, configured, when locked, to prevent access to the courier package, when positioned in the courier-package supportive enclosure and when unlocked, to permit placement of, and retrieval of, the courier package to, and from, the courier-package supportive enclosure, said second lock further configured such that unlocking of the first lock causes unlocking of the second lock and unlocking of the second lock causes unlocking of the first lock; and an identifier configured to identify said housing, identity information of said identifier retrieved pursuant to reporting of placement of the courier package within the courier-package supportive enclosure, said identifier formed of a UPC symbol accessible at least when the front door of said housing is open, the identity information, readable by a bar code scanner, used to track placement of, and retrieval of, the courier package to, and from, the courier-package supportive enclosure.

2. The apparatus of claim 1, wherein said identity information of said identifier is further retrieved pursuant to reporting of removal of the courier package out of the courier-package supportive enclosure.

3. The apparatus of claim 1, wherein placement of the courier package within the courier-package supportive enclosure is performed pursuant to courier delivery of the courier package.

4. The apparatus of claim 1, wherein placement of the courier package within the courier-package supportive enclosure is performed pursuant to sender initiation of sending of the courier package.

5. The apparatus of claim 1, wherein said housing comprises a drawer positionable at least in a non-expanded configuration and in an expanded configuration, said drawer forming part of the courier-package supportive enclosure.

6. The apparatus of claim 5, further comprising a drawer door positionable upon said drawer when positioned in the expanded configuration.

7. The apparatus of claim 1, wherein said first lock comprises a first locking element actuable pursuant to courier delivery of the courier package.

8. The apparatus of claim 1, wherein said first lock comprises a first locking element actuable pursuant to courier pick up of the courier package.

9. The apparatus of claim 1, wherein said first lock comprises a first locking element actuable pursuant to customer placement of the courier package within the courier-package supportive enclosure.

10. The apparatus of claim 1, wherein said second lock comprises a second locking element actuable pursuant to customer retrieval of the courier package within the courier-package support enclosure.

11. The apparatus of claim 1, wherein said first lock comprises a courier locking mechanism and said second lock comprises an owner locking mechanism.

* * * * *